US005946785A

United States Patent [19]

Mühlebach et al.

[11] Patent Number: 5,946,785

[45] Date of Patent: Sep. 7, 1999

[54] PRESSURE JAW FOR A COMPRESSION DEVICE FOR INSTALLATION OF FLOATING FLOOR PANELS

[75] Inventors: Moritz Mühlebach, Wallisellen; Stephan Szabo, Greifensee, both of Switzerland

[73] Assignee: Profloor Technology GmbH, Wallisellen, Switzerland

[21] Appl. No.: 08/997,976

[22] Filed: Dec. 24, 1997

[30] Foreign Application Priority Data

Jan. 6, 1997 [CH] Switzerland ..... 0012/97

[51] Int. Cl.[6] ..... B25B 27/14

[52] U.S. Cl. ..... 29/281.1; 254/11; 269/249

[58] Field of Search ..... 294/103.1; 24/569; 269/249, 219; 254/11–17; 29/281.1

[56] References Cited

U.S. PATENT DOCUMENTS

| | | | |
|---|---|---|---|
| 2,291,020 | 7/1942 | Blomstrom | 254/15 |
| 2,823,011 | 2/1958 | Jones | 254/15 |
| 4,280,683 | 7/1981 | Knierim | 254/17 |
| 4,691,907 | 9/1987 | Yang | 269/249 |
| 5,297,482 | 3/1994 | Cleveland | 294/103.1 |
| 5,788,221 | 8/1998 | Muhlebach et al. | 254/16 |

*Primary Examiner*—Robert C. Watson

*Attorney, Agent, or Firm*—Watson Cole Grindle Watson, P.L.L.C.

[57] ABSTRACT

A pressure jaw (1) at the end of a clamping device for the laying of floating floor coverings like laminates and ready-made parquet which are joined by tongue and groove connections includes a long leg (2) and a perpendicular short leg (3), with a perpendicular horizontally protruding shoulder (5), so as to press against the carrier material of a floor covering plate (4). The long leg (2) includes at least two space adjusting-screws (7) separated from each other and insertable into threaded holes (6), by means of which the distance between it and the pressure jaw (1) can be adjusted by resting it on the floor covering plate (4). It thus occurs that the shoulder (5) presses basically directly below the spring (9) of the floor covering plates (4) of various floor coverings with differing material strength.

3 Claims, 1 Drawing Sheet

PRESSURE JAW FOR A COMPRESSION DEVICE FOR INSTALLATION OF FLOATING FLOOR PANELS

BACKGROUND OF THE INVENTION FIELD OF THE INVENTION

The invention concerns a pressure jaw for a clamping device for laying floating floor coverings, like laminates and ready-made parquet consisting of several parallel, strip-shaped, floor covering plates that are joined to each other by means of interengaging grooves and tongue springs. Such pressure jaws are located at opposite ends of the clamping device so as to press together a number of floor covering plates at the same time by means of the pressure jaws.

THE PRIOR ART

Floating floor coverings which consist of two meter long, strip shaped laminated or ready-made parquet plates are not adhesively bonded over their whole surface to the underlying floor but are instead generally only adhesively bonded to each other along their as a rule, along the two sides which provide tongues or grooves for interengagement therebetween. However, if this adhesive bonding isn't accomplished very exactly in the first rows of a room floor area, the mistakes than add to each other for a totally intolerable result at the end, so that a clean connection to the wall opposite the start of the laying cannot be achieved. Therefore, during the laying of the first rows, a number of the same type clamping devices are used at a distance to each other by means of which the rows of plates are pressed against each other with not too much and not too little pressure. Laminates and ready-made parquet differ in the strength of the material used and the format and, in addition, are dimensioned differently by different manufactures with respect to external dimensions and location of grooves and tongues and consist of a carrier material and a useable layer forming the surface which consists of another kind of wood which must not be damaged during the use of the clamping devices. In addition, the tongue on the edge of the plate which is to be inserted into the groove of a connecting plate must not be deformed by the pressure of a clamping device because the creation of a proper plate connection would then be impossible.

This object of this invention therefore is to provide a pressure jaw for a clamping device which is used for the laying of floating floor coverings during which the pressure jaw only exerts pressure against the carrier material of the floor covering plates during the laying of laminates of thinner material and parquet of thicker material.

SUMMARY OF THE INVENTION

According to this invention the pressure jaw includes a generally flat first leg, a second leg which extends away from one end of the first leg at a 90° angle, and a shoulder flange which extends away from the second leg at a 90° angle and so as to form a generally U-shaped cross sectional configuration with the second leg and the portion of the first leg adjacent the second leg. The first leg is positionable over the top surface of a floor covering element and the shoulder flange is extendable beneath a tongue on the side edge of the element and against the carrier material of the element. Spacer devices attached to the first leg function to space the first leg away from the top surface of the floor covering element and prevent damage thereto.

The invention will be better understood by reference to the accompany drawings taken with the following discussion.

DETAILED DESCRIPTION OF THE PREFERRED EMBODIMENT

Figure 1:
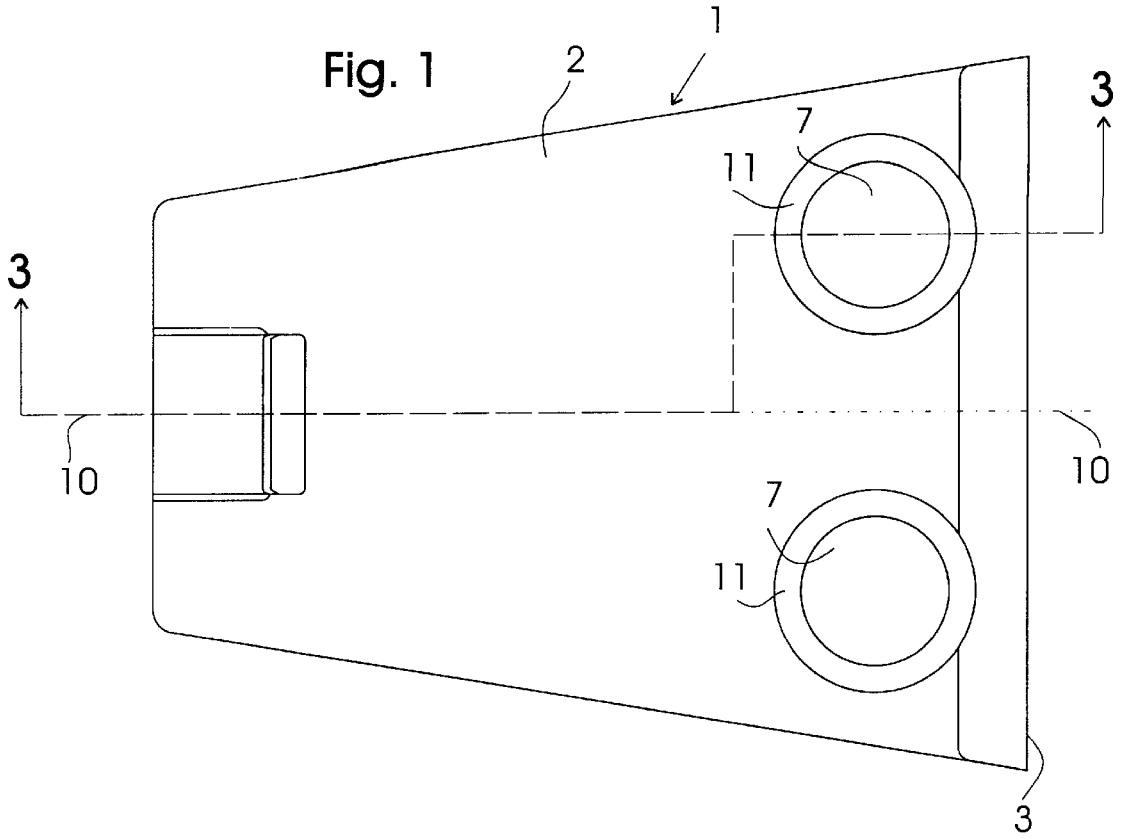
FIG. 1 is a plan view of a pressure jaw according to the present invention
Figure 2:
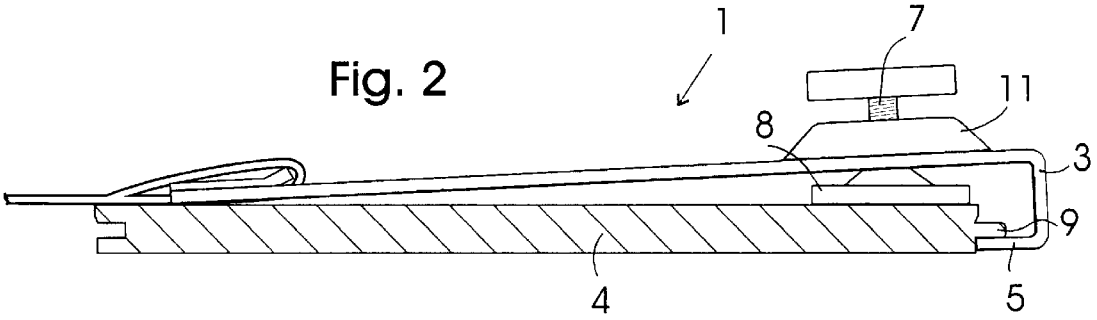
FIG. 2 is side view of the pressure jaw shown resting on a floor covering plate of minimal material strength.
Figure 3:
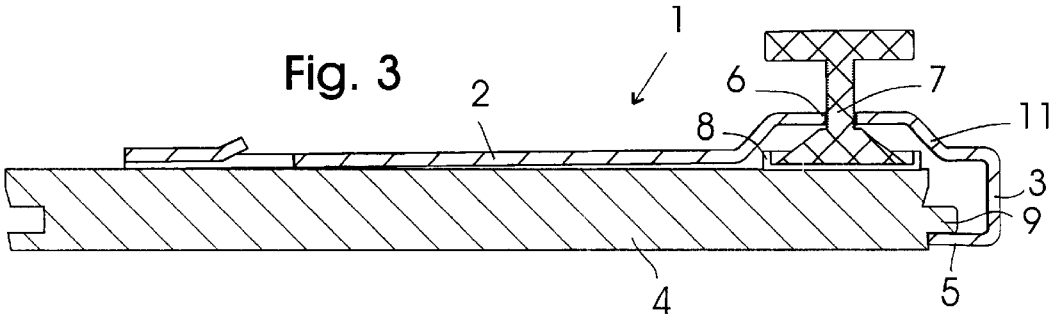
FIG. 3 is a cross-sectional view of the pressure jaw of FIG. 1 as see along line 3—3 when resting on a floor covering plate of more substantial material strength.

The pressure jaw 1 according to this invention forms one end of a clamping device, otherwise not shown, to lay floating floor coverings like laminates and parquet from several, parallel, strip-shaped floor covering plates joined to each other by means of grooves and tongues. The pressure jaw 1, which includes a long leg 2 and a, perpendicular short leg 3, having a perpendicular horizontally protruding shoulder flange 5, is, designed to press against the carrier material of a floor covering plate 4. The long legs 2 includes two space-adjusting screws 7 separated from each other and insertable into threaded holes 6 with a press-on disk 8 at the end, and by means of which the distance between it and the pressure jaw 1 can be adjusted by resting it on the floor covering plate 4. It thus occurs that the shoulder 5 presses basically directly below the tongue 9 of the floor covering plates 4 of various floor coverings with differing material strength. The clamping device, not shown in more detail, can be used as a result with such a pressure jaw to lay laminates and ready-made parquet which consists of stronger material than does the former.

Based on this arrangement, the visible, useable layer on the carrier material of the floor covering plate and the spring of the groove-spring connection will not be damaged during laying. The distance-adjusting screws 7 are located at an even distance from the short leg 3 of the pressure jaw i and at the same distance on both sides of its longitudinal, symmetrical axis 10. There is an area 11 in the long leg 2 of the pressure jaw 1 around the threads 6 for each of the distance-adjusting screws 7 whose shape manifests an upward arch so that the press-on disks 8 of the distance-adjusting screws 7 can find space underneath and the pressure jaw can lay as flat as possible on the floor covering plate 4. An attachment means 12 near the end of the long leg 2 opposite the short leg 3 enables the pressure jaw to be connected to other elements of the clamping device with which it is used.

We claim:

1. A pressure jaw for the end of a clamping device used to clamp together multiple floor covering plate elements that are interengaged by tongue-in-groove sides, said pressure jaw comprising a generally flat first leg having opposite first and second ends, said first leg defining attachment means near said first end for connection to other members of said clamping device; a second leg which extends from said second end of said first leg at about a 90° angle; a shoulder flange which extends from said second leg at about a 90° angle so as to provide a generally U-shaped cross sectional configuration with the second leg and a portion of the first leg at said second end thereof, said first leg being positionable above a top surface of a floor covering plate element and said shoulder flange being positionable beneath a tongue extending away from a side edge of the floor covering element; and two distance adjusting screws which are respectively threaded through holes in said first leg to contact a floor covering element positioned beneath said first leg.

2. A pressure jaw according to claim, 1 wherein said first leg defines a longitudinal, symmetrical axis and wherein said distance adjusting screws are located at an equal distance from the second end of said first leg and from said longitudinal, symmetrical axis.

3. A pressure jaw for the end of a clamping device used to clamp together multiple floor covering plate elements that are interengaged by tongue-in-groove sides, said pressure jaw comprising a generally flat first leg having opposite first and second ends, said first leg defining an upwardly arched area; a second leg which extends from said second end of said first leg at about a 90°0 angle; a shoulder flange which extends from said second leg at about a 90° angle so as to provide a generally U-shaped cross sectional configuration with the second leg and a portion of the first leg at said second end thereof, said first leg being positionable above a top surface of a floor covering plate element and said shoulder flange being positionable beneath a tongue extending away from a side edge of the floor covering element; and two distance adjusting screws which are respectively threaded through holes in the upwardly arched area of said first leg, said screws mounting press on disks at free ends thereof beneath said arched area to contact a floor covering element positioned beneath said first leg.

* * * * *